US008292638B1

(12) United States Patent
Wu et al.

(10) Patent No.: US 8,292,638 B1
(45) Date of Patent: Oct. 23, 2012

(54) TWO-IN-ONE CONNECTOR

(75) Inventors: Dong-Mei Wu, Guang-Dong (CN); Zhu-Rui Liu, Guang-Dong (CN); Jui-Ming Chang, New Taipei (TW)

(73) Assignee: Cheng UEI Precision Industry Co., Ltd., New Taipei (TW)

( * ) Notice: Subject to any disclaimer, the term of this patent is extended or adjusted under 35 U.S.C. 154(b) by 0 days.

(21) Appl. No.: 13/251,179

(22) Filed: Sep. 30, 2011

(51) Int. Cl.
*H01R 12/00* (2006.01)

(52) U.S. Cl. ..... 439/76.1; 439/341; 439/607.01; 439/541.5; 439/627; 439/701

(58) Field of Classification Search ..... 439/76.1
See application file for complete search history.

(56) References Cited

U.S. PATENT DOCUMENTS

| | | | | |
|---|---|---|---|---|
| 5,812,660 | A * | 9/1998 | Suzuki et al. | 379/438 |
| 6,244,894 | B1 * | 6/2001 | Miyashita | 439/500 |
| 6,468,092 | B1 * | 10/2002 | Graff et al. | 439/76.1 |
| 6,511,329 | B2 * | 1/2003 | Yi-Tsung | 439/76.1 |
| 7,244,135 | B2 * | 7/2007 | Chen et al. | 439/327 |
| 7,407,414 | B2 * | 8/2008 | Zuo et al. | 439/630 |
| 7,693,549 | B2 * | 4/2010 | Gallagher | 455/558 |
| 7,950,954 | B2 * | 5/2011 | Liu | 439/500 |
| D648,278 | S * | 11/2011 | Wu et al. | D13/147 |
| 8,077,451 | B2 * | 12/2011 | Tang | 361/679.32 |
| 2004/0058576 | A1 * | 3/2004 | Pellizari | 439/326 |
| 2010/0110648 | A1 * | 5/2010 | Tang | 361/759 |
| 2012/0184137 | A1 * | 7/2012 | Patel et al. | 439/607.01 |

* cited by examiner

*Primary Examiner* — James Harvey
(74) *Attorney, Agent, or Firm* — Cheng-Ju Chiang

(57) ABSTRACT

A two-in-one connector includes an insulating housing, a plurality of first and second terminals, and a shielding shell. The insulating housing has a first base body and a second base body. Each first terminal has a first soldering portion projecting under the first base body to be mounted on a printed circuit board, and a first contact portion projecting beyond a top of the first base body. Each second terminal has a second soldering portion projecting under the second base body to be mounted on the printed circuit board, and a second contact portion projecting beyond a front of the second base body. The shielding shell is mounted on the first base body to define an insertion space therebetween for receiving a SIM card therein to contact with the first contact portions. A battery can be mounted on the shielding shell to contact with the second contact portions.

5 Claims, 4 Drawing Sheets

TWO-IN-ONE CONNECTOR

BACKGROUND OF THE INVENTION

1. Field of the Invention

The present invention generally relates to a two-in-one connector, and more particularly to a two-in-one connector capable of simultaneously receiving a battery and a SIM (Subscriber Identity Module) card therein.

2. The Related Art

At present, appearances of cell phones are developed towards a lighter, more miniaturized and thinner direction. The cell phone generally includes a battery connector and a card connector. A battery is received in the battery connector to provide electricity energy for the cell phone, and a SIM card is received in the card connector to expand storage capacity of the cell phone. In a process of manufacturing the cell phone, the battery connector need be mounted on a printed circuit board of the cell phone by means of SMT (Surface Mounted Technology), and the card connector also need to be mounted on the printed circuit board by means of SMT. However, the battery connector and the card connector are separately mounted to the cell phone to occupy a larger space in the cell phone that can't meet the developing direction of the cell phone. Moreover, mounting the battery connector and the card connector on the printed circuit board need program twice, and even may use two SMT machines. As a result, the cycle time of mounting the battery connector and the card connector on the printed circuit board by means of SMT is extended.

SUMMARY OF THE INVENTION

An object of the present invention is to provide a two-in-one connector adapted for receiving a SIM card and a battery therein. The two-in-one connector includes an insulating housing, a plurality of first terminals, a plurality of second terminals and a shielding shell. The insulating housing has a first base body and a second base body protruding upward from a rear end of a top of the first base body. Two opposite sides of the first base body define two rows of first terminal grooves. The second base body defines a plurality of second terminal grooves arranged at regular intervals. Each first terminal has a first fastening portion received in the first terminal groove. One end of the first fastening portion is inclined downward, and then extends horizontally to form a first soldering portion projecting under the first base body to be mounted on a printed circuit board. The other end of the first fastening portion is curved upward, and then extends horizontally to form a first connecting portion received in the first terminal groove and located over the first fastening portion. A free end of the first connecting portion is arched upward to form a first contact portion projecting beyond the top of the first base body. Each second terminal has a second fastening portion received in the second terminal groove. One end of the second fastening portion is inclined downward, and then extends horizontally to form a second soldering portion projecting under the second base body to be mounted on the printed circuit board. An S-shaped second connecting portion is connected with the other end of the second fastening portion and received in the second terminal groove. A free end of the second connecting portion is arched forward to form a second contact portion projecting beyond a front of the second base body. The shielding shell is mounted on the first base body to define an insertion space between the shielding shell and the top of the first base body for receiving the SIM card therein to contact with the first contact portions of the first terminals. The battery is mounted on the shielding shell to contact with the second contact portions of the second terminals.

As described above, the insulating housing has the first base body, and the second base body protruding upward from the rear end of the top of the first base body. The two opposite sides of the first base body define two rows of the first terminal grooves for receiving the first terminals therein with the first contact portions projecting beyond the top of the first base body to contact with the SIM card and the first soldering portions projecting under the first base body to be mounted on the printed circuit board by means of SMT. The second base body defines a plurality of the second terminal grooves for receiving the second terminals therein with the second contact portions projecting beyond the front of the second base body to contact with the battery, and the second soldering portions projected under the second base body to be mounted on the printed circuit board by means of SMT. Thereby, the two-in-one connector occupies a smaller space in a cell phone and cycle of mounting the two-in-one connector on the printed circuit board of the cell phone by means of SMT is shortened.

BRIEF DESCRIPTION OF THE DRAWINGS

The present invention will be apparent to those skilled in the art by reading the following description, with reference to the attached drawings, in which.

DETAILED DESCRIPTION OF THE PREFERRED EMBODIMENT

Figure 1:
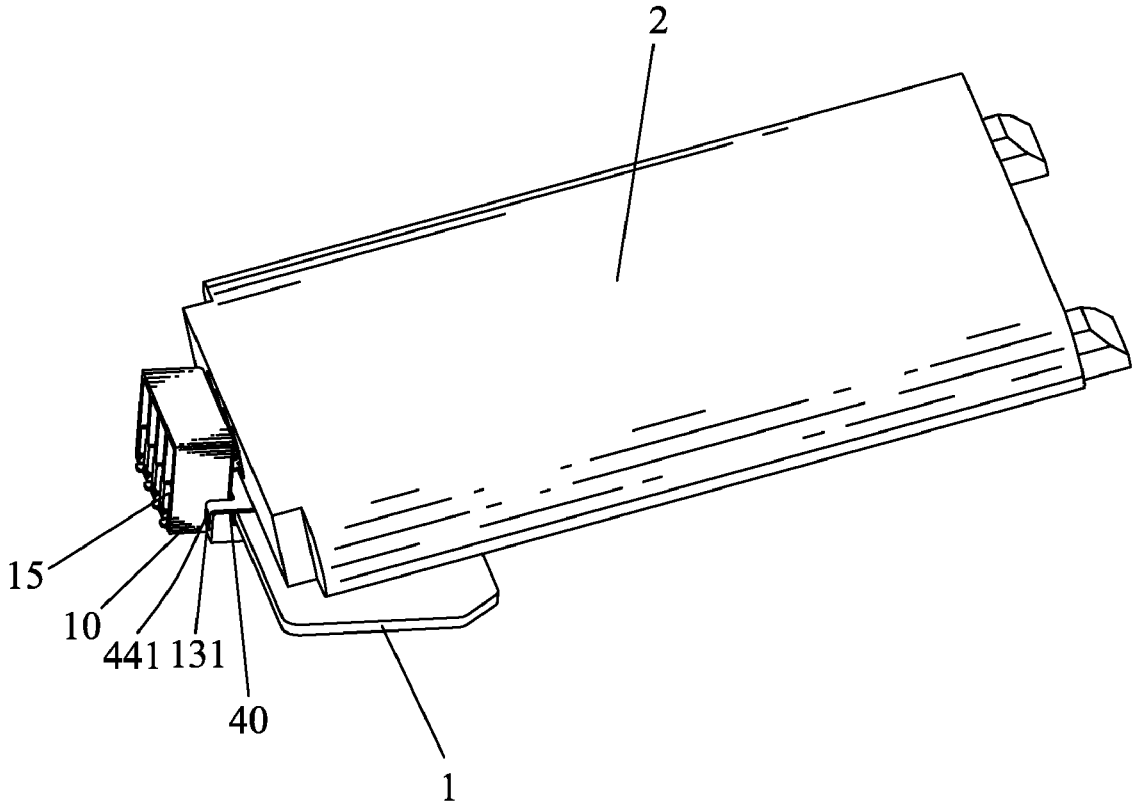
FIG. 1 is a perspective view of a two-in-one connector in accordance with an embodiment of the present invention, wherein a battery and a SIM card are received in the two-in-one connector.
Figure 2:
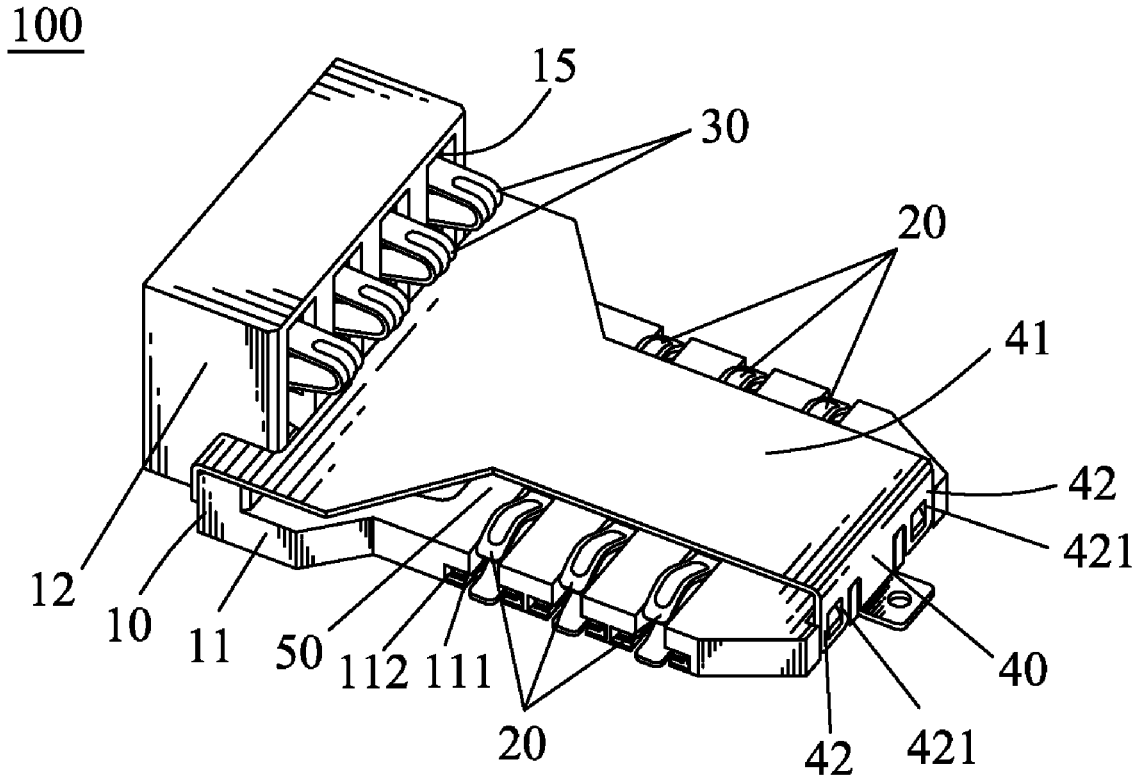
FIG. 2 is a perspective view of the two-in-one connector of FIG. 1.
Figure 3:
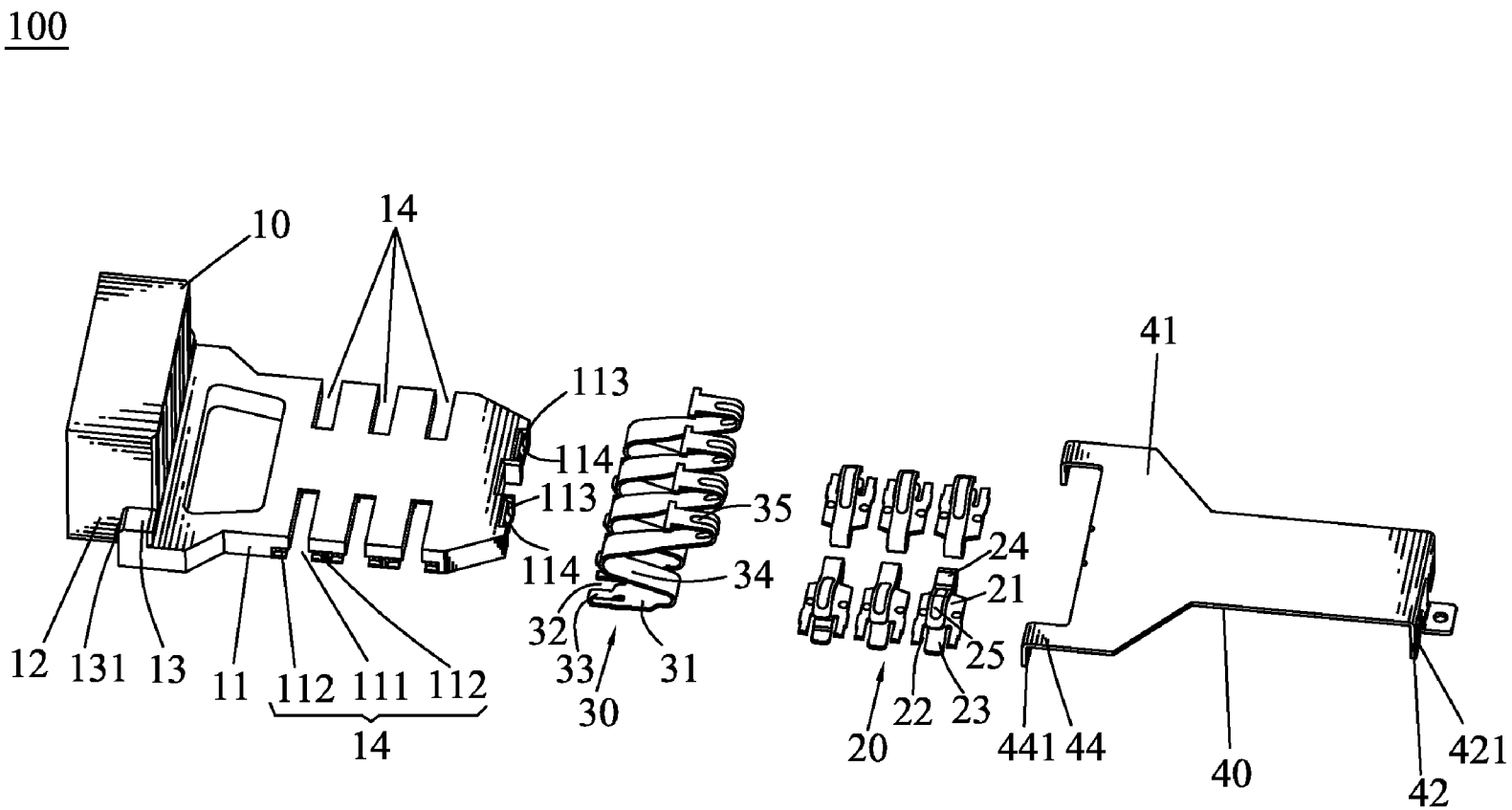
FIG. 3 is an exploded view of the two-in-one connector of FIG. 2.
Figure 4:
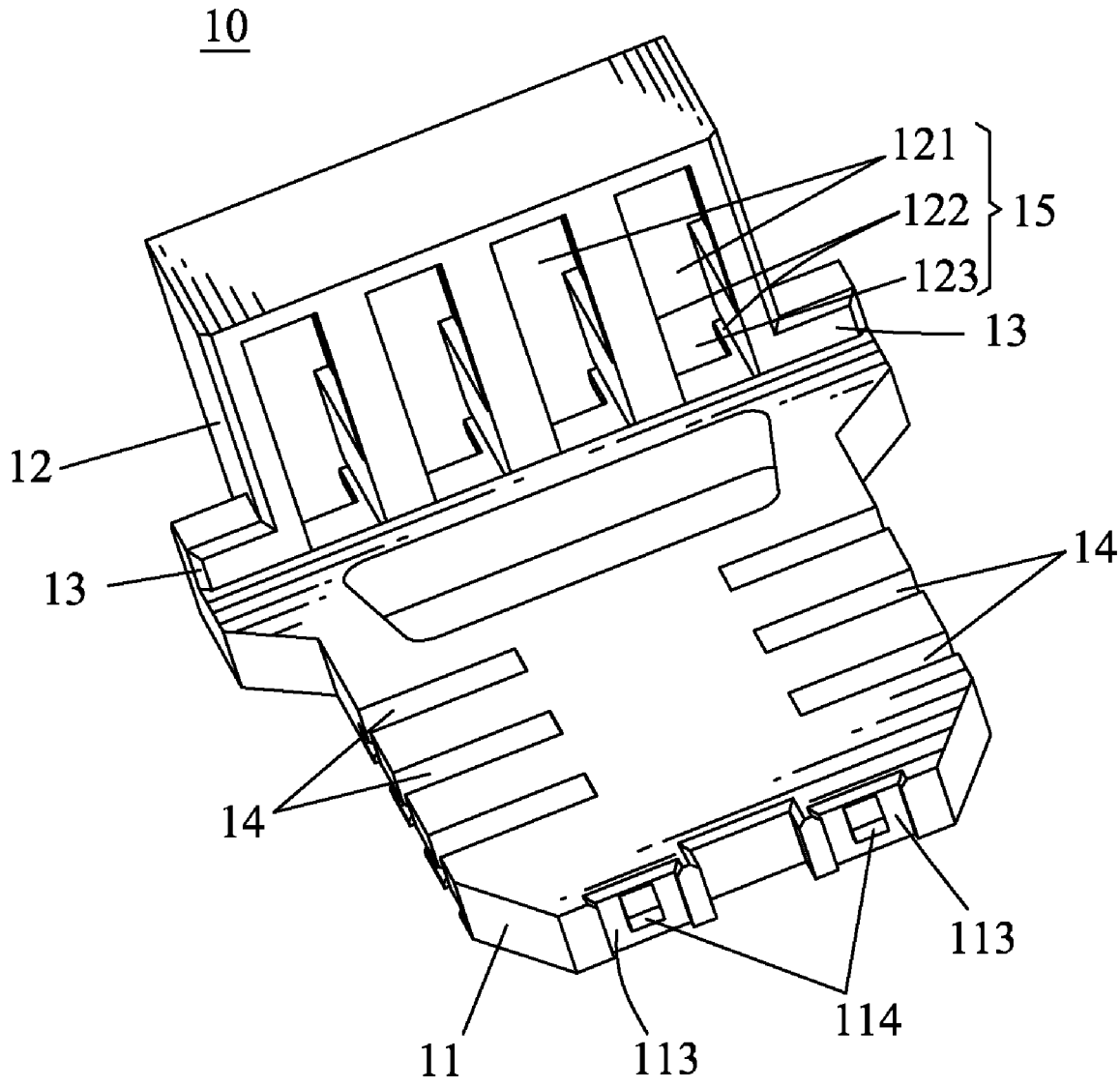
FIG. 4 is a perspective view of an insulating housing of the two-in-one connector of FIG. 3.

With reference to FIG. 1, FIG. 2 and FIG. 3, a two-in-one connector 100 in accordance with an embodiment of the present invention is shown. The two-in-one connector 100 adapted for receiving a SIM card 1 and a battery 2 therein includes an insulating housing 10, a plurality of first terminals 20, a plurality of second terminals 30 and a shielding shell 40.

Referring to FIG. 1, FIG. 2, FIG. 3 and FIG. 4, the insulating housing 10 has a T-shaped first base body 11. A middle of a rear end of a top of the first base body 11 protrudes upward to form a rectangular second base body 12. Two front portions of two opposite sides of the first base body 11 define two rows of first fastening grooves 111 vertically penetrating therethrough and further penetrating through outer edges thereof. Each row of the first fastening grooves 111 is arranged at regular intervals along a longitudinal direction of the first base body 11 and symmetrical to the other row of the first fastening grooves 111. Two sides of a bottom of an outer end of each first fastening groove 111 extend oppositely to form a pair of first fastening slots 112. The first fastening groove 111 and the pair of first fastening slots 112 together define a first terminal groove 14. Two portions of a front surface of the first base body 11 are concaved inward to form two buckling grooves 113 spaced from each other. Two tops of two inner sidewalls of the two buckling grooves 113 protrude forward to form two first buckling portions 114.

The second base body 12 defines a plurality of second fastening grooves 121 arranged at regular intervals along a transverse direction of the second base body 12. Each of the second fastening grooves 121 extends longitudinally to penetrate through the second base body 12, and further extends downward to be lower than the top of the first base body 11. Two bottoms of two opposite inner sidewalls of the second fastening groove 121 are concaved oppositely to form a pair of second fastening slots 122. A rear end of a bottom wall of the second fastening groove 121 is cut off to form an opening 123. The second fastening groove 121, the pair of second fastening slots 122, and the opening 123 together define a second terminal groove 15. Two opposite sides of the rear end of the top of the first base body 11 protrude upward to form two propping portions 13 connecting with two opposite sides of the second base body 12. A top portion of a rear surface of each propping portion 13 protrudes rearward to form a second buckling portion 131.

Referring to FIG. 3, each of the first terminals 20 has a first fastening portion 21. A middle of one end of the first fastening portion 21 is cut off to form a first gap 22. A middle of one inner sidewall of the first gap 22 opposite to the other end of the first fastening portion 21 is inclined downward, and then extends horizontally to form a first soldering portion 23 located under the first gap 22. A middle of the other end of the first fastening portion 21 is curved upward, and then extends horizontally to form a first connecting portion 24. A free end of the first connecting portion 24 is arched upward to form a first contact portion 25 located over the first fastening portion 21.

Referring to FIG. 3 again, each of the second terminals 30 has a second fastening portion 31. A middle of a rear end of the second fastening portion 31 is cut off to define a second gap 32. A middle of one inner sidewall of the second gap 32 opposite to the other end of the second fastening portion 31 is inclined downward, and then extends horizontally to form a second soldering portion 33 located under the second gap 32. An S-shaped second connecting portion 34 is connected with a middle of the other end of the second fastening portion 31 and located over the second fastening portion 31. A free end of the second connecting portion 34 is arched forward to form a second contact portion 35.

Referring to FIG. 2 and FIG. 3, the shielding shell 40 has a substantially T-shaped separating plate 41. Two opposite ends of a front edge of the separating plate 41 extend downward to form two buckling plates 42 with two first buckling holes 421 being opened therein. Two opposite ends of a rear edge of the separating plate 41 extend rearward, and then extend downward to form two inverted L-shaped abutting plates 44 with two second buckling holes 441 being opened therein.

Referring to FIGS. 1-4, when the two-in-one connector 100 is assembled, the first terminal 20 is assembled in the first terminal groove 14 with two opposite sides of the first fastening portion 21 being clipped in the first fastening slots 112, a middle of the first fastening portion 21 and the first connecting portion 24 being received in the first fastening groove 111, the first soldering portion 23 projecting under the first base body 11 through the first fastening groove 111 to be mounted on a printed circuit board (not shown) of a cell phone (not shown), and the first contact portion 25 projecting beyond the top of the first base body 11 through the first fastening groove 111. The second terminal 30 is assembled in the second terminal groove 15 with two opposite sides of the second fastening portion 31 being clipped in the second fastening slots 122, a middle of the second fastening portion 31 and the second connecting portion 34 being received in the second fastening groove 121, the second soldering portion 33 projecting under the second base body 12 through the opening 123 to be mounted on the printed circuit board, and the second contact portion 35 projecting beyond a front of the second base body 12 through the second fastening groove 121. The shielding shell 40 is covered on the insulating housing 10 with the propping portions 13 resisting against bottoms of the abutting plates 44, rears of the abutting plates 44 attached to the rear surfaces of the propping portions 13 by virtue of the second buckling portions 131 being buckled in the second buckling holes 441, and the buckling plates 42 fastened in the buckling grooves 113 by virtue of the first buckling portions 114 being buckled in the first buckling holes 421 to define an insertion space 50 between the top of the first base body 11 and a bottom of the separating plate 41.

In use, the SIM card 1 is inserted into the insertion space 50 of the two-in-one connector 100 to contact with the first contact portions 25 of the first terminals 20 so as to realize an electrical connection between the first terminals 20 and the SIM card 1. Then, the battery 2 is located on the separating plate 41 of the shielding shell 40 of the two-in-one connector 100 to contact with the second contact portions 35 of the second terminals 30 so as to realize an electrical connection between the second terminals 30 and the battery 2.

As described above, the insulating housing 10 has the first base body 11, and the second base body 12 protruding upward from the rear end of the top of the first base body 11. The two opposite sides of the first base body 11 define two rows of the first terminal grooves 14 for receiving the first terminals 20 therein with the first contact portions 25 projecting beyond the top of the first base body 11 to contact with the SIM card 1 and the first soldering portions 23 projecting under the first base body 11 to be mounted on the printed circuit board by means of SMT. The second base body 12 defines a plurality of the second terminal grooves 15 for receiving the second terminals 30 therein with the second contact portions 35 projecting beyond the front of the second base body 12 to contact with the battery 2, and the second soldering portions 33 projecting under the second base body 12 to be mounted on the printed circuit board by means of SMT. Thereby, the two-in-one connector 100 occupies a smaller space in the cell phone and cycle of mounting the two-in-one connector 100 on the printed circuit board of the cell phone by means of SMT is shortened.

What is claimed is:

1. A two-in-one connector adapted for receiving a SIM (Subscriber Identity Module) card and a battery therein, comprising:

an insulating housing having a first base body and a second base body protruding upward from a rear end of a top of the first base body, two opposite sides of the first base body defining two rows of first terminal grooves, the second base body defining a plurality of second terminal grooves arranged at regular intervals;

a plurality of first terminals of which each has a first fastening portion received in the first terminal groove, one end of the first fastening portion inclined downward, and then extending horizontally to form a first soldering portion projecting under the first base body to be mounted on a printed circuit board, the other end of the first fastening portion being curved upward, and then extending horizontally to form a first connecting portion received in the first terminal groove and located over the first fastening portion, a free end of the first connecting portion being arched upward to form a first contact portion projecting beyond the top of the first base body;

a plurality of second terminals of which each has a second fastening portion received in the second terminal groove, one end of the second fastening portion inclined downward, and then extending horizontally to form a second soldering portion projecting under the second base body to be mounted on the printed circuit board, an S-shaped second connecting portion being connected with the other end of the second fastening portion and received in the second terminal groove, a free end of the second connecting portion being arched forward to form a second contact portion projecting beyond a front of the second base body; and a shielding shell mounted on the first base body to define an insertion space between the shielding shell and the top of the first base body for receiving the SIM card therein to contact with the first contact portions of the first terminals, the battery being mounted on the shielding shell to contact with the second contact portions of the second terminals.

2. The two-in-one connector as claimed in claim 1, wherein the shielding shell has a separating plate, of which two opposite ends of a front edge extend downward to form two buckling plates, and two opposite ends of a rear edge extend rearward and then extend downward to form two abutting plates, a front surface of the first base body defines two buckling grooves for respectively fastening bottom ends of the buckling plates therein, two opposite sides of the rear end of the top of the first base body protrude upward to form two propping portions resisting against the two abutting plates to make the separating plate apart located over the first base body.

3. The two-in-one connector as claimed in claim 2, wherein a first buckling hole is opened in each buckling plate, two inner sidewalls of the two buckling grooves define two first buckling portions buckled in the first buckling holes respectively, a second buckling hole is opened in a rear side of each abutting plate, a rear surface of each propping portion defines a second buckling portion buckled in the second buckling hole.

4. The two-in-one connector as claimed in claim 1, wherein each first terminal groove includes a first fastening groove vertically penetrating through the first base body and further penetrating through an outer edge of the first base body, and a pair of first fastening slots extending oppositely in two sides of a bottom of an outer end of the first fastening groove, two opposite sides of the first fastening portion are clipped in the first fastening slots to make a middle of the first fastening portion and the first connecting portion received in the first fastening groove, the first soldering portion projects under the first base body through the first fastening groove.

5. The two-in-one connector as claimed in claim 1, wherein each second terminal groove includes a second fastening groove penetrating through the front and a rear of the second base body, a pair of second fastening slots concaved oppositely in two bottoms of two opposite inner sidewalls of the second fastening groove, and an opening opened at a rear end of a bottom wall of the second fastening groove, two opposite sides of the second fastening portion are clipped in the second fastening slots to make a middle of the second fastening portion and the second connecting portion received in the second fastening groove, the second soldering portion projects under the second base body through the opening.

* * * * *